US006691931B2

(12) United States Patent
Kitajima

(10) Patent No.: US 6,691,931 B2
(45) Date of Patent: Feb. 17, 2004

(54) AIR BRUSH

(75) Inventor: Katsuaki Kitajima, Nagano-ken (JP)

(73) Assignee: B.B. Rich Co., Ltd. (JP)

( * ) Notice: Subject to any disclaimer, the term of this patent is extended or adjusted under 35 U.S.C. 154(b) by 73 days.

(21) Appl. No.: 10/000,014

(22) Filed: Dec. 4, 2001

(65) Prior Publication Data

US 2003/0001027 A1 Jan. 2, 2003

(30) Foreign Application Priority Data

Jun. 27, 2001 (JP) ..... 2001-195209

(51) Int. Cl.[7] ..... B05B 7/30

(52) U.S. Cl. ..... 239/346; 239/319; 239/353; 239/419

(58) Field of Search ..... 239/319, 346, 239/353, 114, 115, 116, 419, 419.3, 433

(56) References Cited

U.S. PATENT DOCUMENTS 1,703,359 A * 2/1929 Paasche ..... 239/353
5,687,913 A * 11/1997 Robisch et al. ..... 239/346
5,779,157 A * 7/1998 Robisch et al. ..... 239/346
5,961,050 A * 10/1999 Kitajima ..... 239/346

* cited by examiner

*Primary Examiner*—Steven J. Ganey
(74) *Attorney, Agent, or Firm*—Bacon & Thomas, PLLC

(57) ABSTRACT

An air brush. The brush includes an adjusting function, in which without bringing about an increase in manufacturing cost, the adjusting function for arbitrarily adjusting a retreating position of a needle is provided and blowing-off of a certain amount of coating material can be easily performed. The air brush is constructed by detachably and threadedly connecting a cap member to a rear section of an air brush body in such a manner that the cap member covers an adjusting screw and a rear portion of the needle. An abutting portion is provided in an interior of the cap member and the chuck adjusting screw is adapted to be abutted against the abutting portion upon retreating of the chuck adjusting screw retreated by the operation of an operating lever.

2 Claims, 4 Drawing Sheets

AIR BRUSH

BACKGROUND OF THE INVENTION

1. Field of the Invention

This invention relates to an air brush and more particularly to an air brush having an adjusting function in which the discharge of coating material is adapted to be kept constant by restricting the pulling position of an operating lever.

2. Description of the Related Art

Among conventional air brushes, there is an air brush as shown in FIG. 5. This air brush 100 includes an air brush body 101 having a nozzle 102 provided at a tip end thereof for spraying coating material, and a needle 103 inserted into an axial core section of the air brush body 101 so as to slidably advance and retract along the axial core section of the air brush body 101. At a middle part of the air brush body 101, an operating lever 104 is provided. By depressing the operating lever 104, an air valve 105 is opened. When the air valve 105 is opened, compressed air which is supplied from an air supplying port 112 connected to a lower portion of the air brush body 101 is adapted to be introduced into an air passageway 106 in the air brush body 101 and blew off from the air nozzle 102.

Also, in the air brush 100, when the operating lever 104 is depressed as described above, the blowing-off of the compressed air from the nozzle 102 starts and, when the operating lever 104 is pulled rearward of the air brush body 101 from the situation, a needle chuck 107 is retreated through an operating plate 109 which is bent into a substantially S-shape.

By the retreating of the needle chuck 107, a tip end of the needle 103 chucked by the needle chuck 107 is retreated, thereby opening the nozzle 102. Upon the opening of the nozzle 102, liquid coating material which is sucked up from a container 108 with the foregoing blowing-off of the compressed air is blew off in a finely atomized state from the opened nozzle 102. That is, the depressing of the operating lever 104 causes the blowing-off of the compressed air to start and the rearward pulling of the operating lever 104 causes the coating material to be blew off. Also, according to the pulling amount of the operating lever 104, the amount of the coating material discharging from the nozzle is controlled so as to increase or decrease.

The above-mentioned air brush 100 has an adjusting screw 110 threadedly mounted on a rear end of the needle chuck 107 for fastening and releasing a chucking portion of the needle chuck. The above-mentioned adjusting screw 110 serves as means to adjust a chucking position at which the needle 103 is chucked by the needle chuck 107. For example, the adjusting screw 110 is loosened and the needle 103 is slid rearwardly in a predetermined amount and, thereafter, the adjusting screw 110 is again tightened, whereby the nozzle 102 can be always kept opened in a predetermined amount in state where the operating lever 104 remains unpulled.

Therefore, in the state as described above, when the operating lever 104 is depressed (is not pulled rearwardly), it is possible to always blow off a certain amount of coating material.

However, when the blowing-off amount of the coating material is to be kept constant as described above, it is necessary to perform the following operation. That is, after a cap member 111 which is threadedly mounted in the rear end of the air brush body 101 is removed from the air brush body 101 and the needle 103 is adjusted, the cap member 111 is again mounted in the air brush body 101. Thus, the operation is troublesome.

On the other hand, among conventional air brushes, an air brush with an adjusting mechanism has been developed in the background of the above problem (FIG. 4).

In the air brush 200, a hollow cap member 211 is threadedly connected to a rear end portion of an air brush body 201 and an adjusting finger-grip 212 for adjusting coating material is threadedly mounted in a rear end portion of the hollow cap member 211. The adjusting finger-grip 212 comprises a gripping portion 211*a* projecting outwardly from a rear end opening of the cap member 211, a threaded portion 211*b* threadedly mounted in the cap member 211 through the rear end opening of the cap member 211, and a pipe-like abutting portion 212*c* which is formed integrally with an end of the threaded portion 211*b* and project from the end of the threaded portion 211*b* towards an adjusting screw 210.

The air brush is constructed such that in situation where the finger-grip 212 is mounted in the cap member 211 as described above, when the adjusting finger-grip 212 is rotated, the abutting portion 212*c* is advanced or retreated in an axial core direction of the air brush body and, when an operating lever 204 is pulled, a rear end surface of a retreated adjusting screw 210 is abutted against a front end surface of the abutting portion 212*c*, thereby limiting the retreating amount of a needle 203.

That is, in the air brush 200 constructed as described above, by the rotational operating of the finger-grip 212, the front end of the abutting portion 212*c* is moved in the axial core direction, and a position at which the adjusting screw is abutted against the abutting portion when the operating lever is pulled, namely, a retreating position of the needle, is determined, whereby discharging of a certain amount of coating material can be always performed. Therefore, the air brush 200 can use the adjusting function by adjusting the rotation of the adjusting screw 210, without the laborious work of removing the cap member when the retreating position of the needle 203 is adjusted.

SUMMARY OF THE INVENTION

As described above, the air brush 200 can easily carry out the adjusting operation of the retreating position of the needle 203. However, the construction of the air brush 200 requires the finger-grip 212 which is threadedly mounted in the rear opening of the cap member 211, so that the number of parts is increased and assembling steps are increased, resulting in additional manufacturing cost being incurred, as compared to the air brush 100 including the cap member 111 only.

An object of the present invention is to provide, in connection with such an air brush as stated above, an arbitrarily adjusting function of the retreating position of the needle without incurring the additional manufacturing cost, and to easily carry out discharging of a certain amount of coating material.

To attain the above object, the air brush according to the present invention includes a substantially cylindrical air brush body having a nozzle provided at a tip end thereof. Inserted into an axial core section of the air brush body is a needle for opening and closing the nozzle which is inserted into and held by a needle chuck which is mounted in the air brush body along the axial core section of the air brush body. Therefore, the needle chuck can hold at a predetermined position the needle inserted therein, and release the needle.

The needle chuck is supported, so as to advance and retract in an axial direction, by an operating lever provided at the air brush body. When the operating lever is operated rearwardly and the needle chuck is retreated, a tip end of the needle is retreated from the nozzle and the nozzle is opened, whereby discharging of coating material is carried out.

Projecting rearwardly of the rear section of the air brush body are a chuck adjusting screw for adjusting the needle chuck so as to tighten and loosen the needle chuck and a rear section of the needle.

A cap member is removably and threadedly connected to the rear section of the air brush body. When the cap member is threadedly connected to the rear section of the air brush body as described above, the adjusting screw and the rear section of the needle are housed in the cap member and covered by the cap member.

When the needle chuck is retreated by the operation of the operating lever, the needle and the chuck adjusting screw are integrally retreated. Provided in an interior of the cap member is an abutting portion. When the needle chuck is retreated by the operation of the operating lever as described above, an end of the chuck adjusting screw is abutted against the abutting portion in the cap member, whereby further retreating of the needle chuck is prevented. That is, by rotating the cap member to cause the cap member to be moved in the axial core direction, the retreating position of the needle is fixed.

Therefore, by rotational operating of the cap member to cause the position of the abutting portion to be moved in an axial direction within the predetermined range, a position (retreating limit) at which the chuck adjusting screw mounted to a rear end of the needle chuck is abutted against the abutting portion is adjustingly moved, and the discharge of coating material from the nozzle is adjustably increased and reduced when the operating lever is operated to the retreating limit.

Furthermore, the air brush according to second aspect of the present invention will be discussed with reference to the following detail description of the preferred embodiment of the present invention.

DESCRIPTION OF THE PREFERRED EMBODIMENT

An embodiment of the present invention will be discussed with reference to the accompanying drawings.

Figure 1:
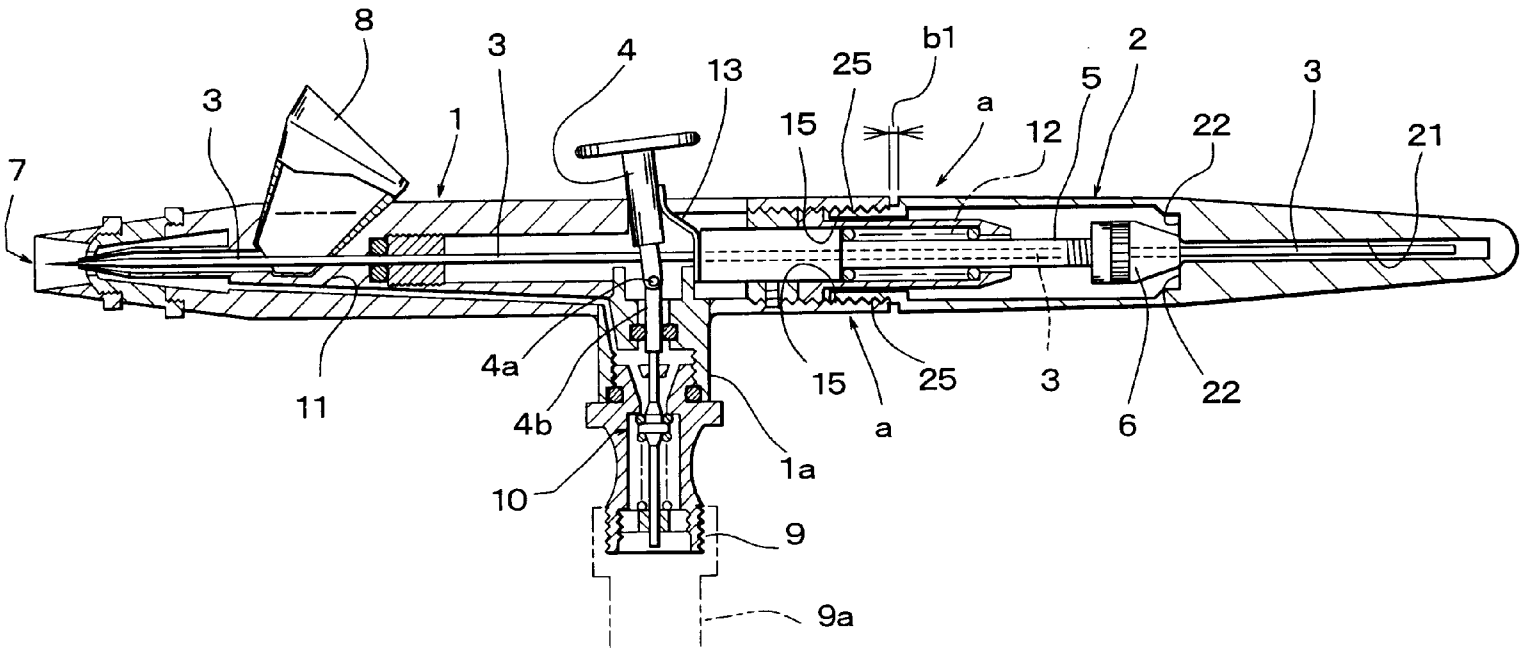
FIG. 1 is a longitudinal sectional view showing an air brush to which the present invention is applied.

An airbrush illustrated in FIG. 1 is an example to which the present invention is applied, in which the air brush is constructed such that a nozzle 7 acting as a blowing port to cause a compressed air and liquid coating material to blow off is provided at a tip end of an air brush body 1 formed into a substantially cylindrical shape, a needle 3 for opening and closing the nozzle 7 is inserted into the air brush body 1 so as to slidably advance and retract along an axial core section and, by operating an operating lever 4 to cause the needle 3 to be retreated, liquid coating material supplied from a coating material container 8 provided at a front section of the air brush body 1 is blew off together with the compressed air from the nozzle 7.

A connecting pipe 9 acting as a connecting port to which a compressed air supplying hose 9*a* is adapted to be connected is threadedly connected to a forked portion 1*a* provided at a middle section of the air brush body 1, and an air valve 10 is provided within the connecting pipe 9.

The air valve 10 is constructed so as to be opened by depressing the operating lever 4. When the air valve 10 is opened, a compressed air flows into the air brush body 1 from the connecting pipe 9 acting as an air supplying port, passes an air passageway 11 provided in the air brush body 1, and blows off from the nozzle 7.

The operating lever 4 has a pushing lever 4*b* connected through an axle 4*a* to a tip end thereof and the pushing lever 4*b* is mounted in an axial core section of the forked portion 1*a* of the air brush body 1, whereby the operating lever 4 is depressibly supported. Also, the operating lever 4 is adapted to be bendable from the axle 4*a* and is tilted rearwardly by pulling operation. Incidentally, a tip end of the pushing lever 4*b* is coupled to the air valve 10 and, the air valve 10 is opened by the depressing operation of the operating lever 4, whereby the supply of the air is started.

On the other hand, the needle 3 which is inserted into the axial core section of the air brush body 1 is supported in state where it is inserted into a needle chuck 5 mounted in an axial core section of a rear portion of the air brush body 1.

The needle chuck 5 chucks and supports the needle 3 so as to allow the needle 3 to advance and retract in an axial direction, and is formed into a substantially pipe-shape. Also, the needle chuck 5 is mounted in the axial core section of the rear portion of the air brush body 1 so as to be slidably advanced and retreated relative to the axial core section, and is supported with a rear end portion thereof slightly projecting from a rear end of the air brush body 1.

Also, an adjusting screw 6 is threadedly mounted on the rear end portion of the needle chuck 5 which projects from the rear end of the air brush body 1, by tightening the adjusting screw 6, a caliber of the rear end opening of the air brush body 1 is reduced, and the adjusting screw 6 is adapted to fasten and hold the needle 3 inserted through a bore of the needle chuck 5. Incidentally, the needle 3 is held with a rear end portion thereof extending rearwardly from the adjusting screw 6.

The needle chuck 5 is always urged forwardly by an elasticity of a spring 12 provided at the middle section of the air brush body 1. Also, an actuating plate 13 which is bent and formed into a substantially S-shape is provided between a front end of the needle chuck 5 and the operating lever 4.

Therefore, when the operating lever 4 is pulled rearwardly against the elasticity of the spring 12 and tilted, the chuck 5 and the needle 3 are slid rearwardly through the actuating plate 13, the nozzle 7 provided at the tip end of the air brush body 1 is opened, and the coating material which is sucked up from the container 8 is discharged from the nozzle 7.

Namely, the air brush is constructed such that the depressing of the operating lever 4 causes the jetting of the compressed air from the nozzle 7 to start and the rearward pulling and tilting of the operating lever 4 causes the coating material to blow off.

A cap member 2 for covering the adjusting screw 6 and the rear portion of the needle 3 is connected to the rear end of the air brush body 1.

Figure 2:
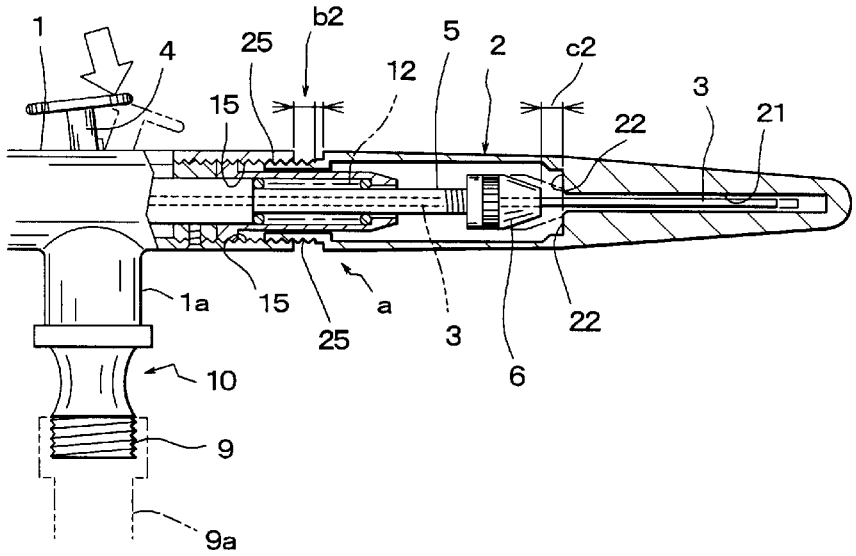
FIG. 2 is a longitudinal side sectional view showing a rear section of the air brush.

As shown in FIGS. 1 and 2, the cap member 2 comprises a cylindrical body, a rear end of which is closed, and an opened front end of which has a threaded portion 25 formed at an outer periphery thereof which is to be threadedly mounted in the rear opening of the air brush body 1. On the other hand, an inner periphery of the rear opening of the air brush body 1 is formed with a threaded opening 15 in which the threaded portion 25 of the cap member 2 is to be threadedly mounted. The threaded portion 25 of the cap member 2 is threadedly mounted in the threaded opening 15 of the air brush body 1, whereby a connecting section a detachably interconnecting the both elements 1, 2 is formed.

Figure 3:
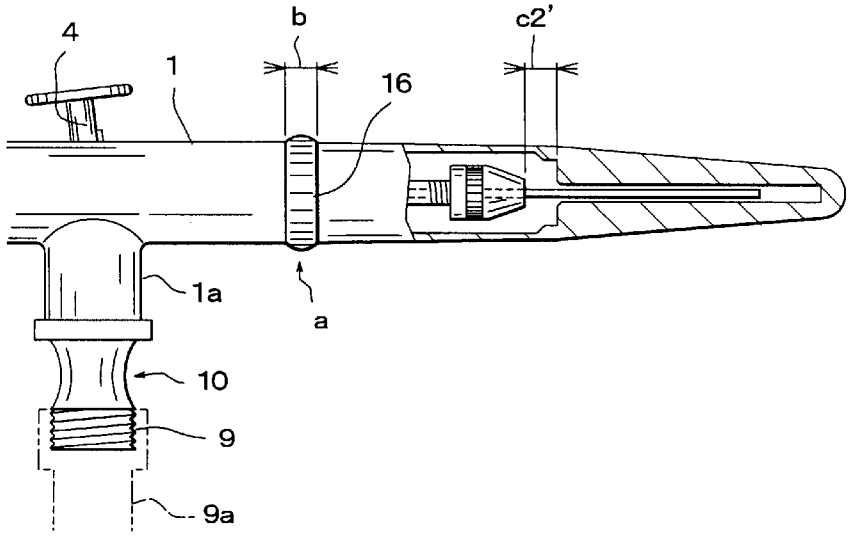
FIG. 3 is a partially cut-away side view showing the rear section of the air brush having a ring mounted thereto.
Figure 4:
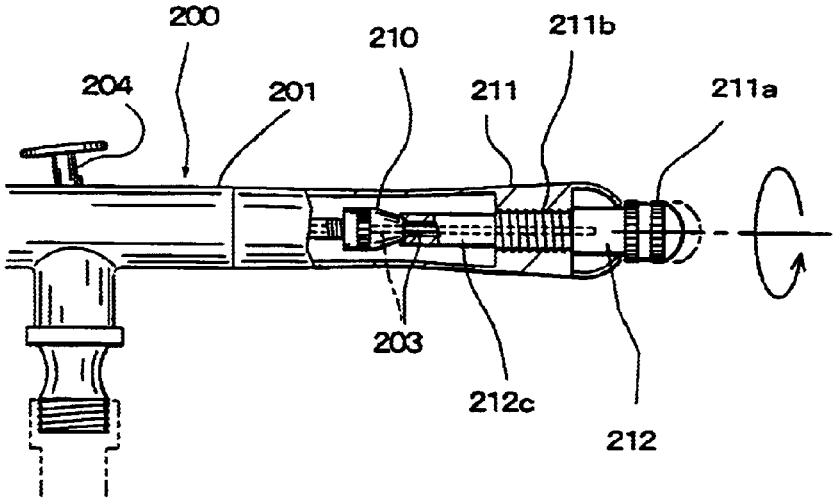
Fig. 4 PRIOR ART
FIG. 4 is a partially cut-away side view showing a rear section of a conventional air brush with an adjusting mechanism.
Figure 5:
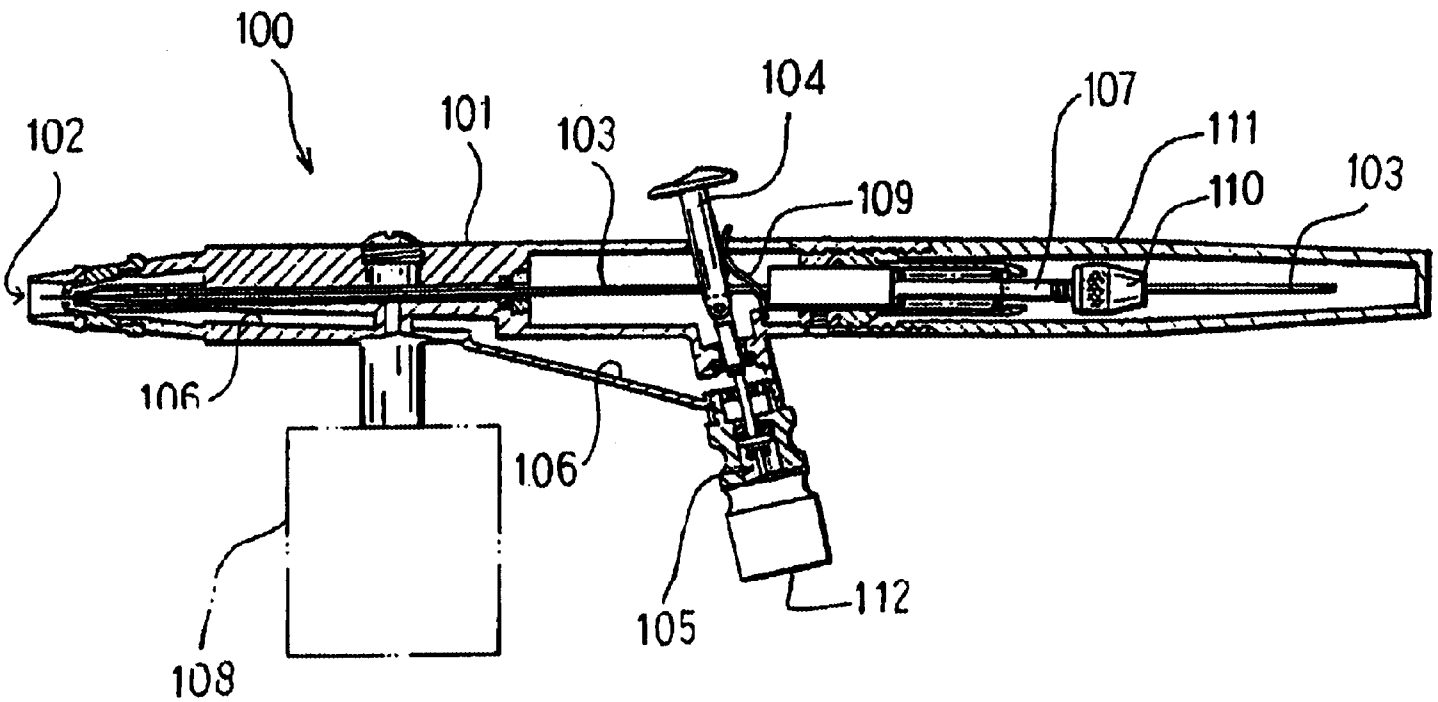
Fig. 5 PRIOR ART
FIG. 5 is a longitudinal sectional view showing a conventional air brush.

A ring 16 is threadedly mounted on the connecting section a and, when the cap member 2 is threadedly connected to the air brush body 1, the ring 16 is interposed between the end surfaces of the air brush body 1 and the cap member 2. Incidentally, a width b of the ring 16 in an axial core direction is set to become slightly wider than a retreating amount c2' of the needle 3 and the adjusting screw 6 when the operating lever 4 is completely pulled (FIG. 3). Incidentally, the ring 16 is used when the air brush of the present invention is used as a normal air brush which does not have the adjusting function. Also, when the air brush is used to take advantage of the adjusting function, the air brush is used in state where the ring 16 is removed from the air brush (FIG. 1).

Incidentally, an inserting bore 21 is provided in an interior of the cap member 2 to extend along a core section of the cap member 2 and a rear portion of the needle 3 which projects from the adjusting screw 6 is inserted in the inserting bore 21. That is, when the operating lever 4 is operated, the rear portion of the needle 3 moving along the axial core forwardly and rearwardly moves along the interior of the inserting bore 21.

Further, the interior of the cap member 2 is provided at a position positionally corresponding to an origin end of the inserting bore 21 with an abutting portion 22 against which an end of the adjusting screw 6 is abutted. When the operating lever 4 is pulled to cause the needle 3 to be retreated and the end of the adjusting screw 6 is abutted against the abutted portion 22, the abutting portion 22 serves to limit the retreating of the adjusting screw 6 and the needle 3. The abutting portion 22 is formed as a surface perpendicular to the needle 3 at a predetermined position in the interior of the cap member 2.

In state where the threaded portion 25 of the cap member 2 is mounted and completely screwed into the threaded opening 15 of the air brush body 1 as described above, that is, in state where the end of the adjusting screw 6 is abutted against the abutting portion 22 (in condition where the operating lever is at an initial point and is not retreated at all (FIG. 1)), the position of the abutting portion 22 provided in the interior of the cap member 2 is set so as to allow a slight space b1, e.g., a space of a little less than 1 mm between a side edge of the base end of the threadedly engaging portion 25 of the cap member 2 and an opening edge portion of the threadedly engaging portion 25 of the air brush body 1. In this connection, the space b1 serves as a margin required for assembling of the air brush and the adjusting and a size of the space varies with a dimensional error.

When the spraying of the coating material is carried out while keeping the discharge of the coating material from the nozzle 7 constant, the cap member 2 is rotated from the above condition in such a direction as to be loosened, to thereby cause the abutting portion 22 in the cap member 2 to be retreated. According to this, the abutting portion 22 is retreated from the end of the adjusting screw 6 and an arbitrary space 2*c* (e.g., 0.1–2 mm or so) is produced between the end of the adjusting screw 6 and the abutting portion 22 (FIG. 2). The space c2 corresponds to the retreating amount of the adjusting screw 6 and the needle 3 upon the complete pulling of the operating lever 4, and the nozzle 7 is opened by an amount corresponding to the space c2. Thereafter, the operating lever 4 is kept completely pulled, whereby a certain amount of the coating material is sprayed.

Further, by the operatively rotating of the cap member 2, the space c between the end of the adjusting screw 6 and abutting portion 22 is increased or reduced, it is possible to arbitrarily set the spraying amount of the coating material, and by pulling of the operating lever 4 to a ultimate retreating position, it is possible to exhibit techniques such as the spraying of the same thick lines of the coating material, spot-blowing of the coating material and the spraying of camouflage lines of the coating material while keeping the spraying amount of the coating material constant, and it is possible to reflect the techniques in a work.

Also, when the air brush is used as a normal air brush which does not have the adjusting function, the ring 16 is threadedly mounted on and exists at the connecting section a between the air brush body 1 and the cap member 2 (FIG. 3). This will cause the space c2 between the end of the adjusting screw 6 and the abutting portion 22 within the cap member 2 to exceed the moving distance of the adjusting screw 6 retreated by the pulling of the operating lever 4, so that the operating lever 4 can be ultimately pulled and the air brush can be unchangingly used as compared to the normal air brush. Further, in situation where the ring 16 is threadedly mounted on the connecting section a and interposed between the air brush body 1 and the cap member 2, any space is not produced at the connecting section a. This is externally preferable.

Furthermore, the ring 16 is not necessarily provided and the air brush may be used without the ring 16.

Also, if the sizes of the threadedly engaging portion 25 and the abutting portion 22 are adjusted for a conventional air brush, the cap member 2 and the ring 16 can be mounted on an air brush which a user has already owned, and the same adjusting function as the above embodiment of the present invention has can be provided to the conventional air brush.

Furthermore, while the embodiment is constructed such that the threaded portion 25 (external thread) of the cap member 2 is threadedly mounted in the threaded opening 15 (internal thread) of the air brush body 1, the threadedly mounting relationship between the external thread and the internal thread may be reversed, that is, the air brush body has the external thread and the cap member 2 has the internal thread (not shown).

Also, the shape of the abutting portion provided in the cap member 2 may not be limited to any form, insofar as it can be integrated with the cap member, abutted against the end of the adjusting screw 6 retreating and can stop the retreating of the adjusting screw.

Since the air brush of the present invention is constructed as described, by the rotating of the cap member threadedly connected to the rear portion of the air brush body and the adjusting of the axial core directional movement of the abutting portion provided in the interior of the cap member, together with the movement of the cap member, a position at which the chuck adjusting screw is abutted against the abutting portion, that is, an ultimately retreating position of the needle, can be arbitrarily set.

Therefore, like the conventional air brush provided the adjusting knob (adjusting mechanism), the air brush of the present invention can be used so as to spray the coating material while keeping the discharge of the coating material from the nozzle constant when the operating lever is pulled to the ultimate retreating position.

Also, in situation where the operating lever is operated to the ultimate retreating position by rotating the cap member to cause the cap member to be moved in the axial direction within the range of the threaded engagement of the connecting section, the discharge of the coating material from the nozzle can be adjustably increased and reduced and it is possible to perform the spraying of the predetermined thick lines of the coating material, spot-blowing of the coating material and the spraying of the camouflage lines of the coating material while keeping the spraying in a best condition.

Furthermore, the air brush of the present invention can be provided with the adjusting mechanism only by the provision of the abutting portion in the interior of the cap member as the adjusting mechanism for receiving and stopping the operating lever at the ultimate retreating position, so that the air brush can be provided with the mechanism for adjusting the ultimate retreating position of the operating lever, namely, the adjusting mechanism for keeping the discharge of the coating material constant, while keeping the same manufacturing cost as that of the conventional air brush without the adjusting mechanism.

The air brush according to second aspect of the present invention is constructed, in the above air brush, such that the ring having a predetermined width is removably and threadedly mounted on the threadedly connecting section between the air brush body and the cap member and is interposed between the air brush body and the cap member. Therefore, in the event that the adjusting mechanism of the air brush is not used, by threadedly mounting the ring on the threadedly connecting section, the margin space corresponding to the width of the ring is produced between the end of the chuck adjusting screw and the abutting portion within the cap member to render the adjusting mechanism unavailable, whereby the air brush can be used perfectly like the conventional air brush. Also, in a used-condition, the threadedly connecting section between the air brush body and the cap member has no margin space for adjusting the movement of the cap member, so that this is externally preferable.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. An air brush comprising:

a substantially cylindrical air brush body having a nozzle provided at a top end thereof;

a needle inserted into an axial core section of the air brush body for opening and closing the nozzle;

a needle chuck mounted in the air brush body along the axial core section of the air brush body, the needle being inserted into and held by the needle chuck, the needle chuck being capable of advancing and retreating in an axial direction by operation of an operating lever provided at the air brush body;

a chuck adjusting screw for adjusting the needle chuck so as to allow the needle chuck to be tightened and loosened;

the chuck adjusting screw and a rear section of the needle being projected rearwardly from a rear section of the air brush body;

a cap member removably and threadedly connected to the rear section of the air brush body so as to cover the chuck adjusting screw and the rear section of the needle; and wherein the improvement comprises an abutting portion provided in an interior of the cap member, the chuck adjusting screw is adapted to be abutted against the abutting portion upon retreating of the chuck adjusting screw retreated by the operation of the operating lever, and the position of the abutting portion is adapted to be adjusted so as to be moved in an axial direction within a predetermined range according to rotational operation of the cap member.

2. The air brush according to claim 1, wherein a ring having a predetermined width is removably and threadedly mounted on a threadedly connecting portion between the air brush body and the cap member and is interposed between the air brush body and the cap member.

* * * * *